US007187887B2

(12) United States Patent
Inaba

(10) Patent No.: US 7,187,887 B2
(45) Date of Patent: Mar. 6, 2007

(54) IMAGE FORMING UNIT AND MANUFACTURING METHOD THEREOF

(75) Inventor: Yuichiro Inaba, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 59 days.

(21) Appl. No.: 10/941,111

(22) Filed: Sep. 15, 2004

(65) Prior Publication Data

US 2005/0207784 A1 Sep. 22, 2005

(30) Foreign Application Priority Data

Mar. 17, 2004 (JP) ..... P2004-076747

(51) Int. Cl.
*G03G 21/18* (2006.01)

(52) U.S. Cl. ..... 399/113; 399/116; 399/117; 399/121; 399/302

(58) Field of Classification Search ..... 399/302, 399/113, 308, 116, 117, 121, 110, 111
See application file for complete search history.

(56) References Cited

U.S. PATENT DOCUMENTS 5,313,255 A * 5/1994 Taniguchi et al. ..... 399/117
5,752,134 A * 5/1998 Hazama et al. ..... 399/113
6,807,393 B2 * 10/2004 Sameshima et al. ..... 399/113
6,934,485 B2 * 8/2005 Miyabe et al. ..... 399/90
6,937,834 B2 * 8/2005 Kanno et al. ..... 399/114
6,980,761 B2 * 12/2005 Yamada ..... 399/302

FOREIGN PATENT DOCUMENTS

JP 62159157 A * 7/1987
JP 2003-195729 A 7/2003

* cited by examiner

*Primary Examiner*—David M. Gray
*Assistant Examiner*—Geoffrey T Evans
(74) *Attorney, Agent, or Firm*—Sughrue Mion, PLLC

(57) ABSTRACT

After having assembled an intermediate transfer assembly and an image carrier unit, an operator attaches a bearing to a hole section in a side frame, inserts one end of a pivotal shaft of an image carrier into the bearing attached to the hole section, turns the pivotal shaft with one end of the pivotal shaft attached to the bearing serving as a pivot, and runs the other end of the pivotal shaft through a notch in the side frame. The operator attaches a bearing to the other end of the pivotal shaft run through the notch from the axial direction of the pivotal shaft, and fixes the bearing onto the side frame by a fixing member.

7 Claims, 10 Drawing Sheets

IMAGE FORMING UNIT AND MANUFACTURING METHOD THEREOF

BACKGROUND OF THE INVENTION

1. Field of the Invention

The present invention relates to an image forming unit for forming an image, and to a method for manufacturing the same.

2. Description of the Related Art

Known image forming apparatuses include those wherein a photosensitive member and an intermediate transfer belt are unitized to configure an image forming unit which can be attached to/detached from an image forming apparatus main body.

Such an image forming apparatus has been known to employ an image forming unit manufactured by assembling a photosensitive member unit, comprising a photosensitive member, and frames for supporting the photosensitive member, onto an intermediate transfer member unit having an intermediate transfer belt (see JP-A-2003-195729).

In the above-mentioned conventional image forming unit, the number of connecting points between the intermediate transfer member unit and the photosensitive member unit is increased for the purpose of increasing connection rigidity between the same, and in some cases, this inhibits enhancement of productivity of the image forming unit.

SUMMARY OF THE INVENTION

The present invention aims at providing an image forming unit which can be manufactured easily, as well as a method for manufacturing the same.

To this end, a first aspect of the present invention provides an image forming unit including an intermediate transfer belt having elasticity; a plurality of rollers around which the intermediate transfer belt is wound; a pair of side frames for connecting the rollers; and a photosensitive member installed on the side frames. One of the side frames includes a hole section into which one end of the photosensitive member is inserted; and the other side frame includes a notch into which the other end of the photosensitive member is inserted. When the above configuration is adapted, even when one end of the photosensitive member is inserted into the hole section on one of the side frames, the other end of the photosensitive member is inserted in the notch in the other side frame. Accordingly, the photosensitive member can be easily assembled onto the side frames, thereby enabling easy manufacture of the image forming unit.

Another aspect of the present invention provides a method of manufacturing an image forming unit, comprising a step of assembling an intermediate transfer assembly including an intermediate transfer belt having elasticity, a plurality of rollers around which the intermediate transfer belt is wound, and a pair of side frames which support the rollers; and a subsequent step of inserting a cylindrical photosensitive member into the side frames in such a manner that the photosensitive member exerts tension on the intermediate transfer belt. More specifically, since the above configuration is set such that the photosensitive member exerts tension on the intermediate transfer belt, the photosensitive member serves as a connecting point between the photosensitive member and the intermediate transfer assembly, thereby enabling a decrease in the number of connecting points for assembling the photosensitive member onto the intermediate transfer assembly. Accordingly, the image forming unit can be manufactured easily. Furthermore, because the photosensitive member exerts tension on the intermediate transfer belt, a tension roller or the like for exerting tension on the intermediate transfer belt is not required. Consequently, the image forming unit can be manufactured more easily.

Preferably, the photosensitive member and the intermediate transfer belt are brought into contact with each other in a wrapping manner by means of inserting the photosensitive member. More specifically, by means of installing the photosensitive member, the photosensitive member and the intermediate transfer belt can come into face-to-face contact with each other, and the photosensitive member can apply pressure on the intermediate transfer belt. Consequently, a configuration for generating pressure between the photosensitive member and the intermediate transfer belt can be simplified, and the image forming unit can be manufactured easily.

Preferably, the side frames are disposed on opposing ends of the rollers. The photosensitive member is assembled by inserting one end of the photosensitive member into one of the side frames, and subsequently inserting the other end of the photosensitive member into the other one of the side frames. More specifically, when one end of the photosensitive member is installed in one of the side frames after insertion of the other end of the photosensitive member into the other one of the side frames, the photosensitive member receives repulsive force from the intermediate transfer belt. Therefore, an operator can insert the other end of the photosensitive member into the other one of the side frames by means of suppressing the repulsive force received by the photosensitive member on the other end. Accordingly, the operator can assemble the photosensitive member without use of a special jig, or the like.

Preferably, the one end of the photosensitive member is first inserted into a hole section disposed in one of the side frames, and subsequently the other end of the photosensitive member is engaged with a notch disposed in the other one of the side frames. Therefore, an operator can engage the other end of the photosensitive member with the notch on the other one of the side frames by means of turning the photosensitive member with one end of the photosensitive member, which is inserted into the hole section disposed in one of the side frames, serving as a pivot. Accordingly, the operator can easily assemble the photosensitive member.

According to the present invention, an image forming unit can be manufactured easily.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Next, an embodiment of the present invention will be described with reference to the drawings.

Figure 1:
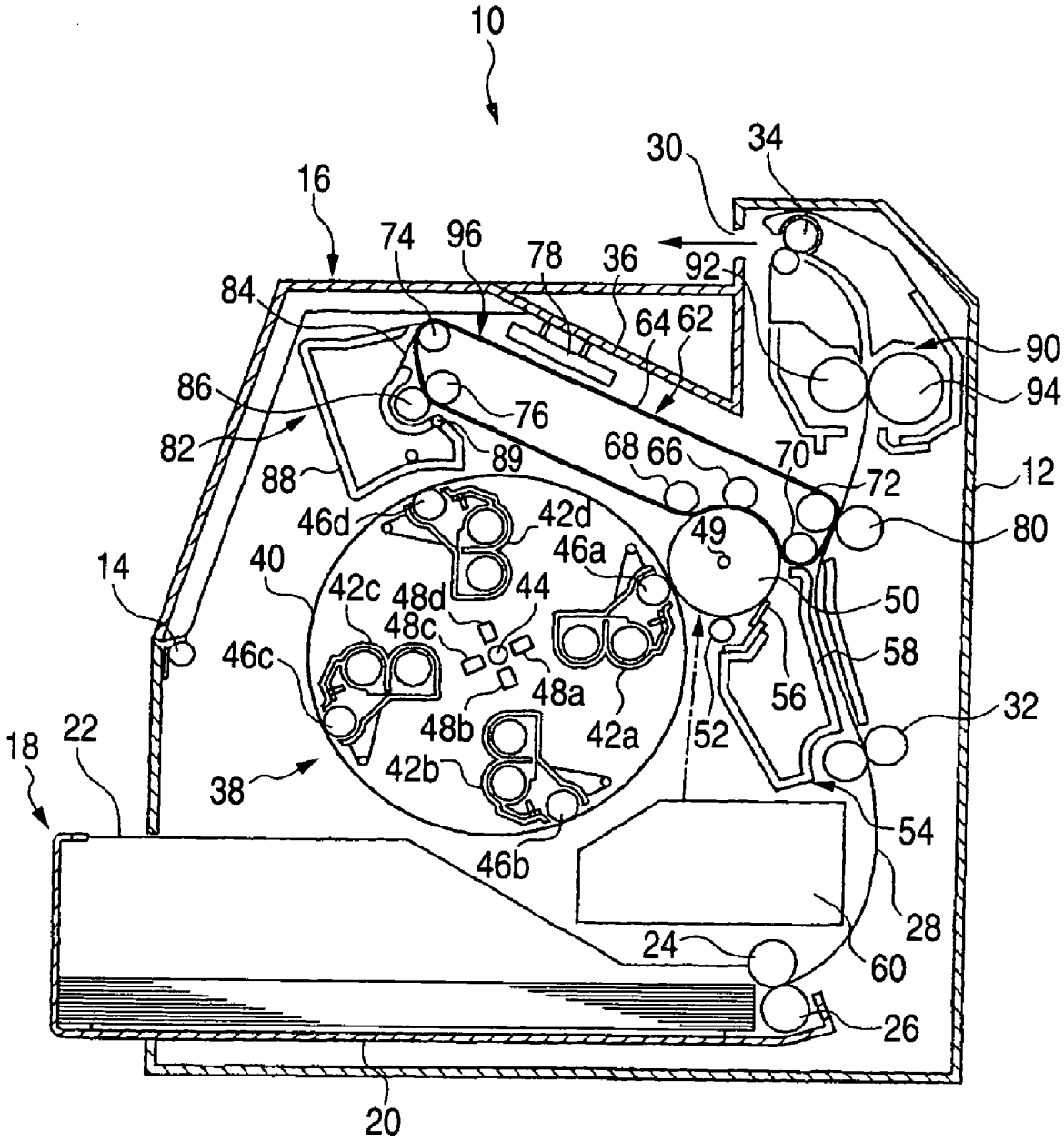
FIG. 1 is a side view of an image forming apparatus employing an image forming unit manufactured according to a method of manufacturing the same according to an embodiment of the present invention.
Figure 2:
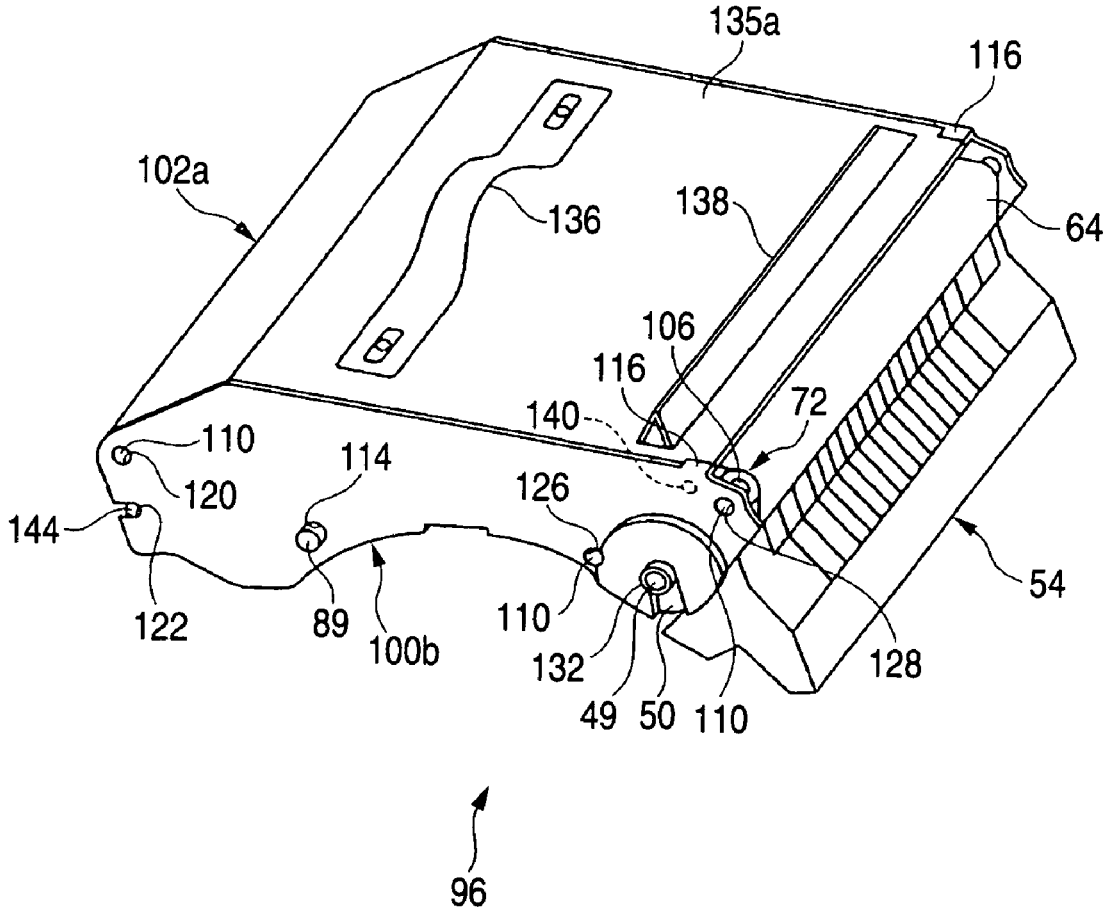
FIG. 2 is a perspective view of the image forming unit manufactured according to the method of manufacturing the same according to the embodiment of the present invention.

FIG. 1 shows general features of an image forming apparatus 10 manufactured according to a method for manufacturing an image forming unit according to the embodiment of the present invention. The image forming apparatus 10 includes an image forming apparatus main body 12. A reclosable cover 16, which is rotatable about a pivot 14, is disposed on an upper portion of the image forming apparatus main body 12, and a paper supply unit 18 of, e.g., a single stage is disposed on a lower portion of the image forming apparatus main body 12.

The paper supply unit 18 has a paper supply unit main body 20, and a paper supply cassette 22 which contains paper. A feed roller 24 for supplying paper from the paper cassette 22 and a retard roller 26 for dispensing a single sheet of paper at a time from the thus-supplied paper are disposed at an upper position in the vicinity of a deep inner end of the paper supply cassette 22.

A transport path 28 is a paper path from the feed roller 24 to a discharge port 30. The transport path 28 is disposed substantially vertically from the paper supply unit 18 to a fuser 90, which will be described later, in the vicinity of a back side (the right side face in FIG. 1) of the image forming apparatus main body 12. A secondary transfer roller 80 and a secondary transfer back-up roller 72, both of which will be described later, are disposed upstream of the fuser 90 along the transport path 28. Furthermore, a registration roller 32 is disposed upstream of the secondary transfer roller 80 and the secondary transfer back-up roller 72. In addition, a discharge roller 34 is disposed along the transport path 28, in the vicinity of the discharge port 30.

Therefore, when paper is fed out from the paper supply cassette 22 of the paper supply unit 18 by means of the feed roller 24 and is dispensed by the retard roller 26, only a single sheet of paper on the top is guided to the transport path 28, and the sheet of paper is temporarily stopped by the registration roller 32. At an appropriate timing, a toner image is transferred to the paper while the paper passes between the secondary transfer roller 80 and the secondary transfer back-up roller 72, both of which will be described later. The thus-transferred toner image is fixed by the fuser 90, and discharged from the discharge port 30 to a discharge section 36 disposed on the upper portion of the reclosable cover 16, by means of the discharge roller 34. The discharge section 36 is inclined such that a discharge port section thereof is lowered, and gradually increases in height in a frontward direction (i.e., leftward in FIG. 1).

A rotary developing device 38 is disposed in the image forming apparatus main body 12 at, e.g., a substantially center portion. The rotary developing device 38 has developing devices 42*a* to 42*d* which form four color toner images of yellow, magenta, cyan, and black. The developing devices 42*a* to 42*d* rotate leftward (i.e., counterclockwise in FIG. 1) about a rotary developing device center 44. Each of the developing devices 42*a* to 42*d* has a developing roller 46*a* to 46*d*, and is pressed in the tangential direction of the developing device main body 40 by means of an elastic member 48*a* to 48*d*, such as a coil spring.

An image carrier 50 formed from, e.g., a photosensitive material, and is disposed so as to abut against the rotary developing device 38 from the back side of the image forming apparatus 10. A portion of an outer periphery of each of the developing rollers 46*a* to 46*d* projects, e.g., 2 mm in the radial direction from the outer periphery of the developing device main body 40, while being disengaged from the image carrier 50. Furthermore, tracking rollers (unillustrated) having a radius slightly larger than that of the developing rollers 46*a* to 46*d* are disposed on opposing ends of each of the developing rollers 46*a* to 46*d* so as to rotate about the same axis with the developing roller 46*a* to 46*d*. More specifically, the developing rollers 46*a* to 46*d* of the developing devices 42*a* to 42*d* are disposed at 90, intervals on the outer periphery of the developing device main body 40, and tracking rollers of the developing rollers 46*a* to 46*d* abut against flanges (unillustrated) disposed on opposing ends of the image carrier 50. A latent image on the image carrier 50 is developed with toners of the respective colors while a gap of predetermined size is maintained between the developing rollers 46*a* to 46*d* and the image carrier 50.

An electrifying device 52 configured from, e.g., a charging roller, which uniformly charges the image carrier 50, is disposed below the image carrier 50. An image carrier cleaner 54 is held on the image carrier 50 in such a manner as to be suspended from a pivotal shaft 49. The image carrier 50 and the image carrier cleaner 54 are integrated. The image carrier cleaner 54 is configured from, e.g., a cleaning blade 56 which scrapes waste toners remaining on the image carrier 50 after a first transfer, and a toner collecting bottle 58 which collects the waste toners scraped by the cleaning blade 56.

A rib or the like is disposed on the back side (the right side in FIG. 1) of the toner collecting bottle 58, and forms a part of the transport path in a curved surface so as to transport paper smoothly.

An exposure device 60 for recording a latent image on the image carrier 50, which has been charged by the electrifying device 52, by means of light rays, such as a laser beam, is disposed below the back side of the rotary developing device 38. An intermediate transfer device 62 is disposed above the rotary developing device 38. The intermediate transfer device 62 performs primary transfer of a toner image visualized by the rotary developing device 38 at a primary transfer point, and transports the image thus primarily transferred to a secondary transfer position, which will be described later.

The intermediate transfer device 62 includes an intermediate transfer member 64, such as an intermediate transfer belt, as well as a primary transfer roller 66, a wrap-in roller 68, a wrap-out roller 70, the secondary back-up roller 72, a scraper back-up roller 74, and a brush back-up roller 76. The intermediate transfer member 64 has, e.g., elasticity, and is stretched substantially flat in such a manner that its longer and shorter sides are placed above the rotary developing device 38. The longer sides of the upper surface of the intermediate transfer member 64 are stretched, e.g., so as to be substantially parallel to the discharge section 36 disposed on the upper portion of the image forming apparatus main body 12. Furthermore, the intermediate transfer member 64 has the wrap-in roller 68 disposed upstream of the primary transfer roller 66 below the longer sides of the intermediate member 64 and a primary transfer section (image carrier wrap range) contacting the image carrier 50 in a wrapping manner between the wrap-in roller 68 and the wrap-out roller 70 disposed downstream of the primary transfer roller 66. The intermediate transfer member 64 wraps around the image carrier 50 only over a predetermined range, to thus be driven by rotation of the image carrier 50. As described above, the intermediate transfer member 64 is subjected to a primary transfer of the toner image onto the image carrier 50 by, for instance, superposing yellow, magenta, cyan, and black toners, in the order given. The thus-primarily-transferred toner image is transported toward the secondary transfer roller 80, which will be described later. The wrap-in roller 68 and the wrap-out roller 70 are separated from the image carrier 50.

As described above, the intermediate transfer member 64 is supported in a tensioned manner by five rollers consisting of the wrap-in roller 68, the wrap-out roller 70, the secondary transfer back-up roller 72, the scraper back-up roller 74, and the brush back-up roller 76. A toner image on the image carrier 50 is transferred on the intermediate transfer member 64 by means of the primary transfer roller 66.

Furthermore, a flat portion (transverse side) of the intermediate transfer member 64 is formed by the wrap-out roller 70 and the secondary transfer back-up roller 72 on a back side (the right side face in FIG. 1) of the intermediate transfer member 64. The flat portion serves as a secondary transfer section which faces the transport path 28.

The wrap-out roller 70 in the secondary transfer section is disposed such that the intermediate transfer member 64 and the transport path 28 form an angle of, e.g., 12.

The scraper back-up roller 74 assists a scraper 84, which will be described later, to scrape waste toners remaining on the intermediate transfer member 64 after a secondary transfer. The brush back-up roller 76 assists a brush roller 86, which will be described later, to scrape waste toners remaining on the intermediate transfer member 64 after the secondary transfer.

A sensor 78, such as a reflective photosensor, is disposed above the longer sides of the intermediate transfer member 64 by means of being fixed on the back side (i.e., the inner side) of the reclosable cover 16. The sensor 78 reads a patch of the toner formed on the intermediate transfer member 64, thereby detecting a position of the intermediate transfer member 64 in the rotating direction, as well as sensing a toner concentration.

The secondary transfer roller 80 is disposed so as to oppose the secondary transfer back-up roller 72 with the transport path 28 therebetween. More specifically, a portion between the secondary transfer roller 80 and the secondary transfer back-up roller 72 serves as the secondary transfer position in the secondary transfer section. The secondary transfer roller 80 performs secondary transfer of the toner image, which has been primarily transferred on the intermediate transfer member 64, onto paper at the secondary transfer position, with assistance from the secondary back-up roller 72. The secondary transfer roller 80 is disengaged from the intermediate transfer member 64 while the intermediate transfer member 64 rotates three times; i.e., during transportation of toners of the colors yellow, magenta, and cyan. Furthermore, the secondary transfer roller 80 abuts the intermediate transfer member 64 after completion of transfer of the black toner. The secondary transfer roller 80 and the secondary transfer back-up roller 72 are configured such that a predetermined potential difference is generated therebetween. For instance, when the secondary transfer roller 80 is under a high potential, the secondary transfer back-up roller 72 is connected to the ground (GND), or the like.

An intermediate transfer member cleaner 82 is disposed at the end of the intermediate transfer member 64 opposing the image carrier 50. The intermediate transfer member cleaner 82 has the scraper 84, the brush roller 86, a toner collecting bottle 88, and a pivotal shaft 89, and sways about the pivotal shaft 89. The scraper 84 scrapes waste toners remaining on the intermediate transfer member 64, e.g., after a secondary transfer, thereby performing cleaning. The brush roller 86 further scrapes waste toners remaining after the cleaning by the scraper 84. The toner collecting bottle 88 collects the toners scraped by the scraper 84 and the brush roller 86. The scraper 84 is made of a thin metal plate; e.g., a stainless steel plate, and a voltage having a polarity opposite that of the toner applied on the scraper 84. The brush roller 86 is made of, e.g., an acrylic brush which has been subjected to conductivity processing. Furthermore, the scraper 84 and the brush roller 86 are disengaged from the intermediate transfer member 64 during transportation of the toner by the intermediate transfer member 64, and the scraper 84 and the brush roller 86 abut against the intermediate transfer member 64 at a predetermined timing in an integrated manner.

The intermediate transfer device 62, the image carrier 50, the electrifying device 52, the image carrier cleaner 54, and the intermediate transfer member cleaner 82 are integrated so as to configure a portion of an image forming unit 96, which will be described later.

The fuser 90 is disposed above the secondary transfer position. The fuser 90 has a heating roller 92 and a pressing roller 94. The fuser 90 fixes the toner image which has been secondarily transferred onto the paper by the secondary transfer roller 80 and the secondary transfer back-up roller 72 on the paper, and transports the paper toward the discharge roller 34.

FIGS. 2 to 7 show details of the image forming unit 96.

Figure 3:
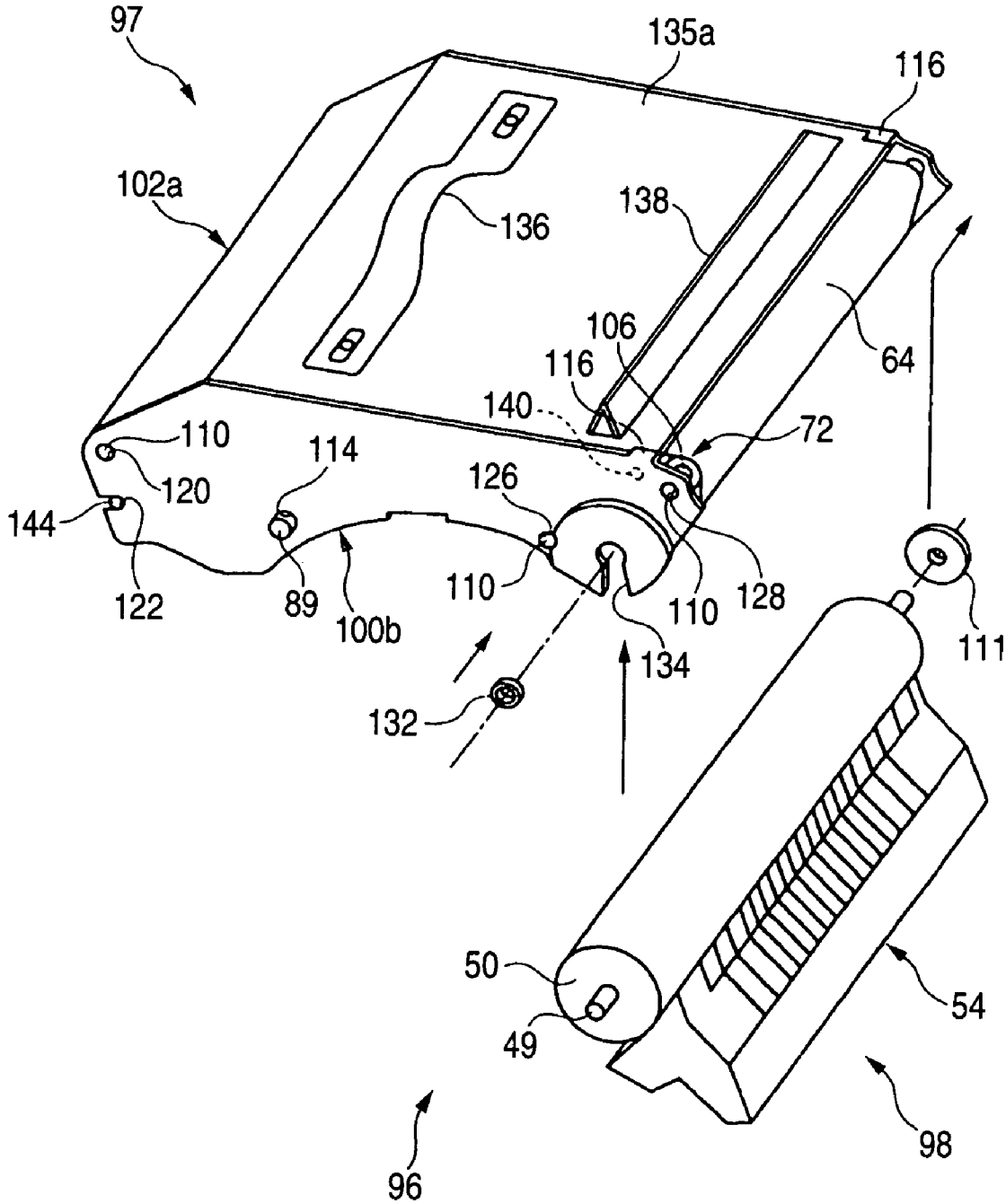
FIG. 3 is a perspective view showing the image forming unit shown in FIG. 2 when disassembled into an intermediate transfer assembly and an intermediate carrier unit.
Figure 4:
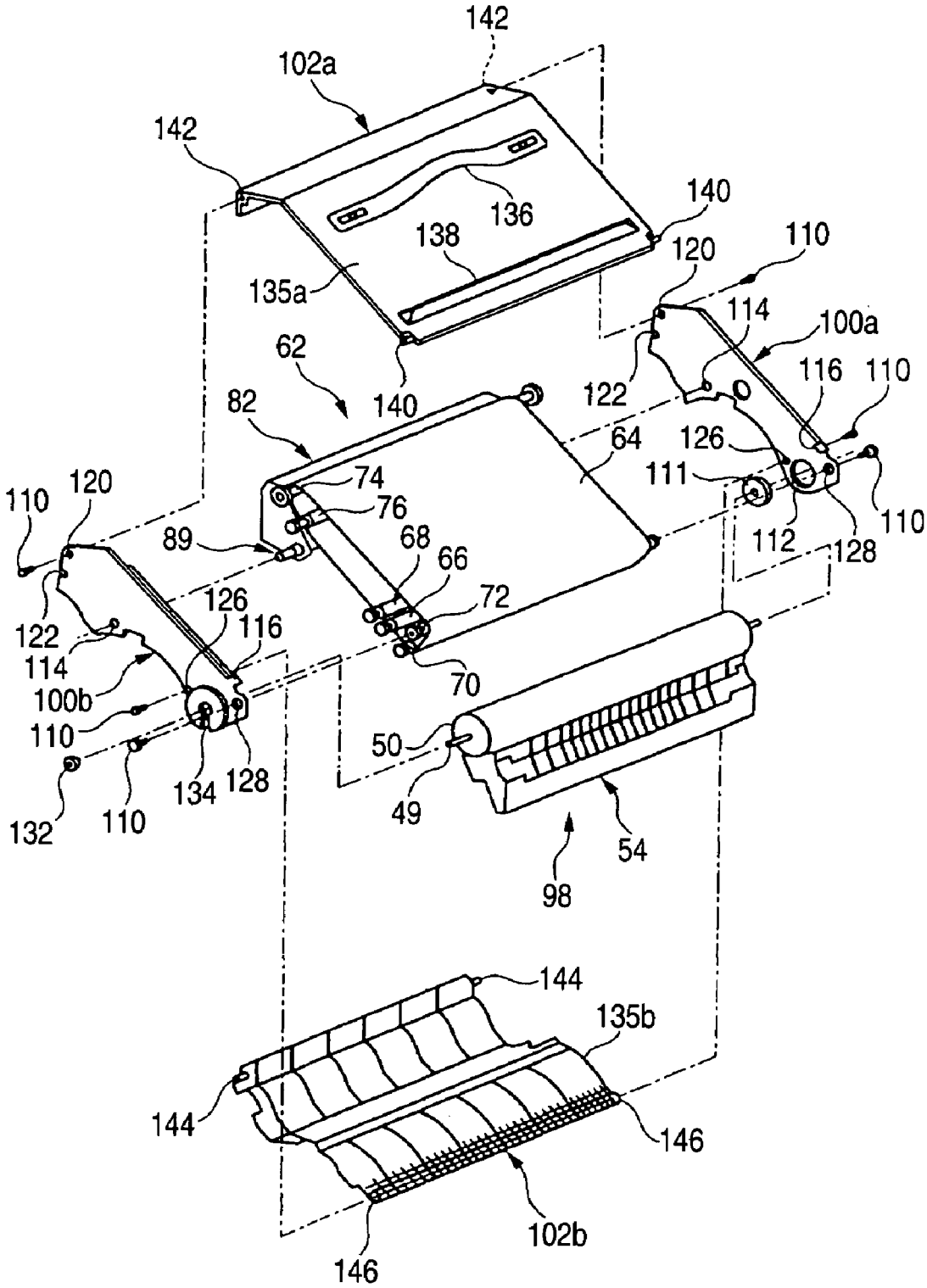
FIG. 4 is an exploded perspective view of the image forming unit shown in FIG. 2.
Figure 5:
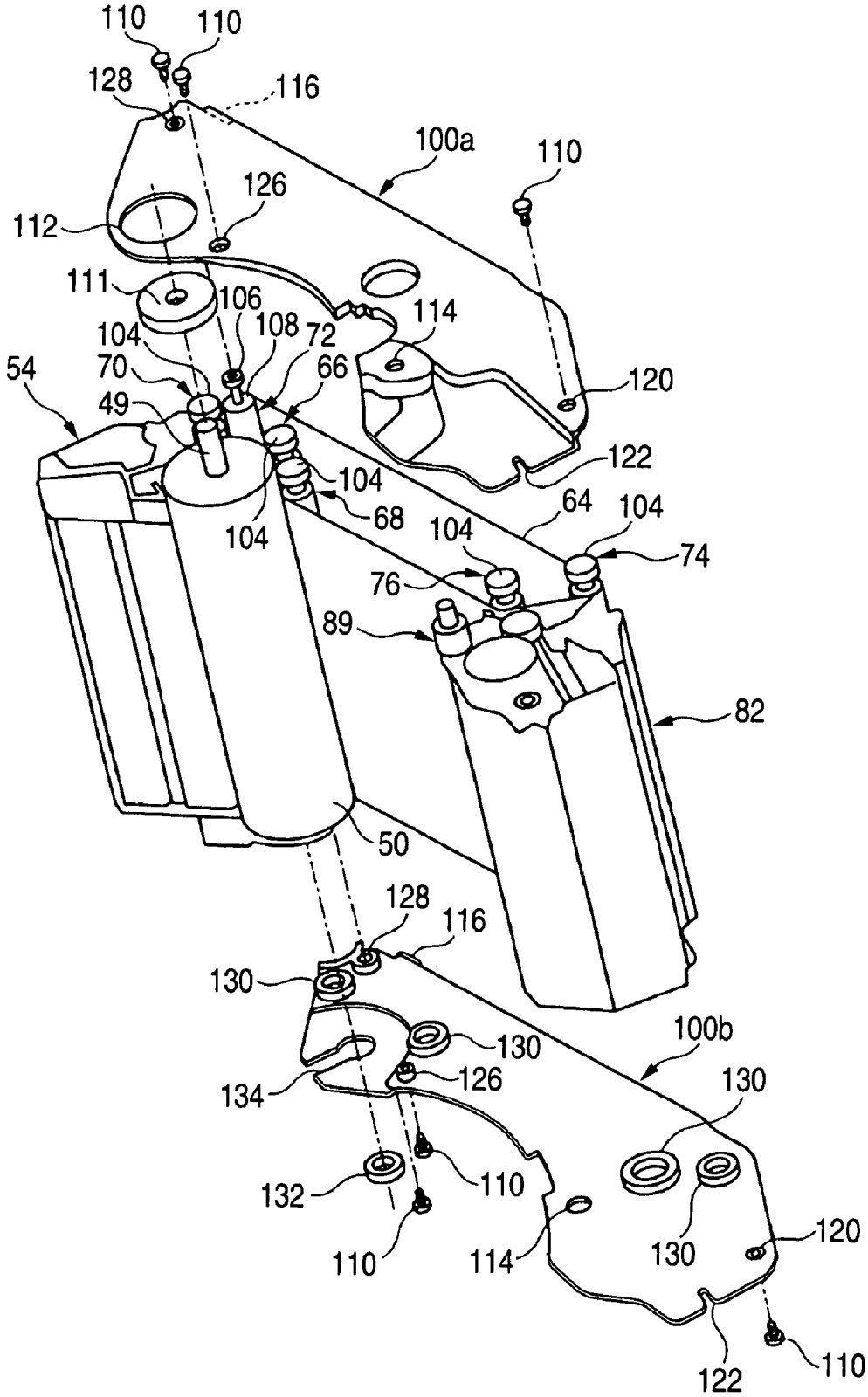
FIG. 5 is an exploded perspective view of the image forming unit shown in FIG. 2 as viewed from below with protective covers removed.
Figure 6:
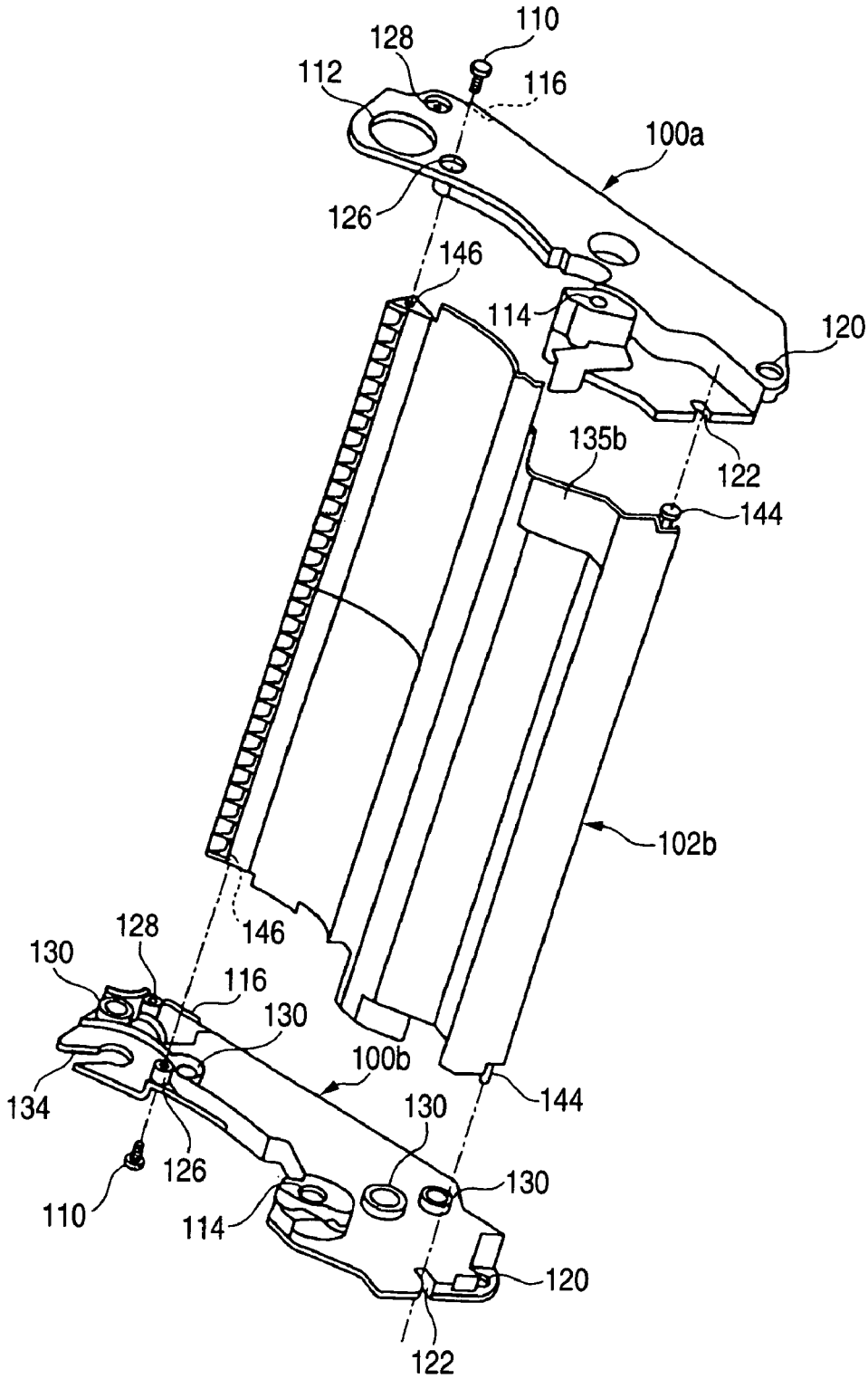
FIG. 6 is an exploded perspective view of the image forming unit shown in FIG. 2 showing connection between a lower protective cover and side frames.
Figure 7:
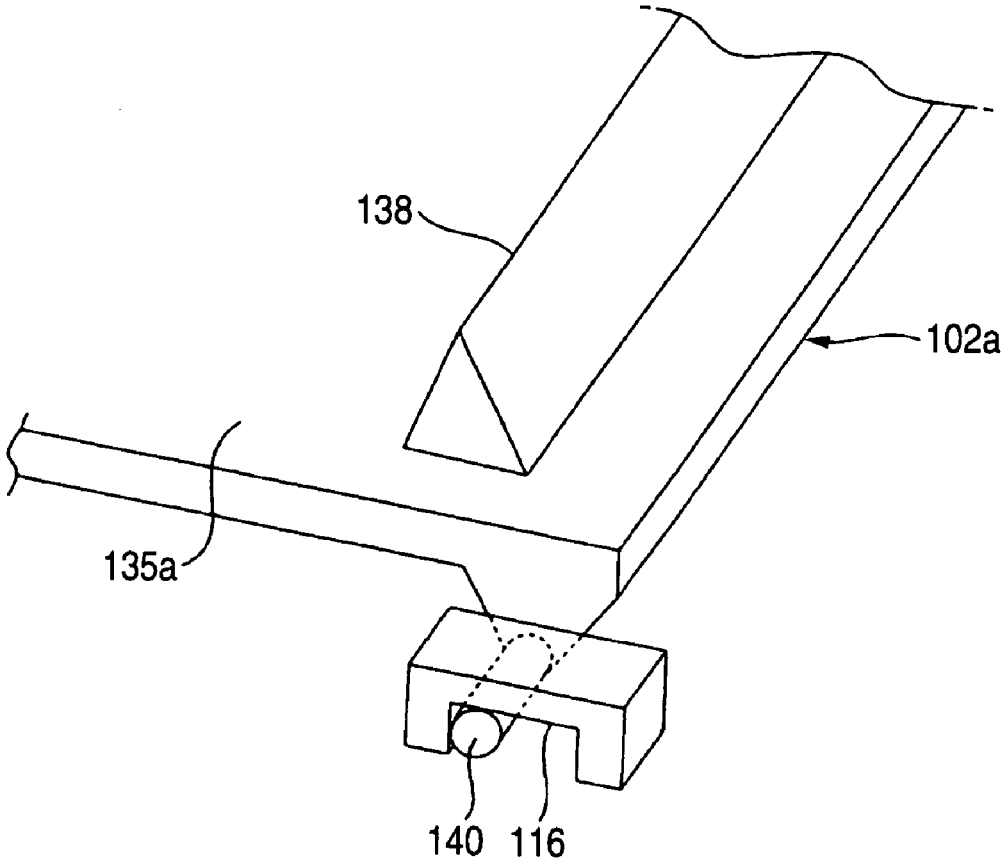
FIG. 7 is an enlarged view of the image forming unit shown in FIG. 2 showing engagement between an upper protective cover and a recessed section in the side frames.

The image forming unit 96 is configured by integrating a pair of side frames 100*a*, 100*b* disposed on the right and left (on the right and left in FIG. 4) respectively; a pair of protective covers 102*a*, 102*b* disposed on the top and bottom (on the top and bottom in FIG. 4), respectively; the intermediate transfer device 62; the image carrier 50; the electrifying device 52; the image carrier cleaner 54; and the intermediate transfer member cleaner 82. Furthermore, the side frames 100*a*, 100*b*, the protective covers 102*a*, 102*b*, the intermediate transfer device 62, and the intermediate transfer member cleaner 82 are integrated to form an intermediate transfer assembly 97. Furthermore, the image carrier 50, the electrifying device 52, and the image carrier cleaner 54 are integrated to form an image carrier unit 98. More specifically, as also shown in FIG. 3, the image forming unit 96 is configured by assembling the image carrier unit 98 to the intermediate transfer assembly 97 by way of bearings 111 and 132, both of which will be described later. The image carrier unit 98 is caused to be attached to/detached from the intermediate transfer assembly 97. When the image carrier unit 98 is attached to the intermediate transfer assembly 97, a predetermined tension is exerted on the intermediate transfer assembly 97. Consequently, a primary transfer section is formed between the intermediate transfer assembly 97 and the image carrier 50.

The intermediate transfer member 64 is rotatably supported by five rollers consisting of the secondary transfer back-up roller 72, the wrap-in roller 68, the wrap-out roller 70, the scraper back-up roller 74, and the brush back-up roller 76. A toner image, which has been transferred from the primary transfer roller 66 and is carried by the image carrier 50, is transferred onto the intermediate transfer member 64. Each of the primary transfer roller 66, the wrap-in roller 68, the wrap-out roller 70, the scraper back-up roller 74, and the brush back-up roller 76 has bearings 104 (see FIG. 5) disposed on opposing ends thereof, and is supported on the side frames 100*a*, 100*b* via the bearings 104. The secondary transfer back-up roller 72 has a shaft section 106, and a rotating section 108 which rotates about the shaft section 106. Opposing ends of the shaft section 106 are respectively fixed to the side frames 100*a*, 100*b* by means of fixing members 110, 110, such as screws.

The side frame 100*a* is run through by the pivotal shaft 49 of the image carrier 50, and has a hole section 112 for supporting one end of the pivotal shaft 49 via the bearing 111, and a hole section 114 for allowing the pivotal shaft 89 of the intermediate transfer cleaner 82 to run therethrough. The pivotal shafts 49 and 89 protrude laterally from the side frame 100*a*. A recessed section 116 (see FIG. 7), with which a protrusion 140 to be described later on the protective cover 102*a* is to be engaged, is rested on an upper part of the side frame 100*a* facing the image carrier 50. A hole section 120 in which a fixing section 142, which will be described later, of the protective cover 102*a* is to be fixed by means of the fixing member 110 is disposed on the intermediate transfer cleaner 82 side of the upper portion of the side frame 100*a*. A recessed section 122 with which a protrusion 144, which will be described later, of the protective cover 102*b* is to be engaged is disposed on the intermediate transfer cleaner 82 side of the lower portion of the side frame 100*a*. A hole section 126 in which a fixing section 146, which will be described later, of the protective cover 102*b* is to be fixed by the fixing member 110 is disposed on the image carrier 50 side of the lower portion of the side frame 100*b*.

A fixing section 128 for fixing one end of the shaft section 106 of the secondary transfer back-up roller 72 by means of the fixing member 110 is disposed on the side frame 100*a*. Receiving sections 130 (see the side frame 100*b* shown in FIG. 5) for laterally supporting one end of each of the wrap-in roller 68, the wrap-out roller 70, the scraper back-up roller 74, and the brush back-up roller 76 via the bearings 104 are respectively disposed on the inner side of the side frame 100*a*. One end of the primary transfer roller 66 is supported on the side frame 100*a* via the bearing 104 and an unillustrated retention member.

The side frame 100*b* is run through by the pivotal shaft 49 of the image carrier 50, and has a notch 134 for supporting one end of the pivotal shaft 49 via the bearing 132, and a hole section 114 for allowing the pivotal shaft 89 of the intermediate transfer member cleaner 82 to run therethrough. The pivotal shafts 49 and 89 laterally protrude from the side frame 100*b*. Of the notch 134, the width of the portion where the pivotal shaft 49 runs through is smaller than that where the bearing 132 is attached. The bearing 132 is fixed on the side frame 100*b* by an unillustrated fixing member, such as a screw. A recessed section 116 (see FIG. 7), with which the protrusion 140 to be described later of the protective cover 102*a* is to be engaged, is rested on an upper part of the side frame 100*b* facing the image carrier 50. A hole section 120 in which a fixing section 142, which will be described later, of the protective cover 102*a* is to be fixed by the fixing member 110 is disposed on the intermediate transfer cleaner 82 side of the upper portion of the side frame 100*b*. A recessed section 122 with which a protrusion 144, which will be described later, of the protective cover 102*b* is to be engaged is disposed on the intermediate transfer cleaner 82 side or the lower portion of the side frame 100*b*. A hole section 126 in which a fixing section 146, which will be described later, of the protective cover 102*b* is to be fixed by means of the fixing member 110 is disposed on the image carrier 50 side of the lower portion of the side frame 100*b*.

A fixing section 128 for fixing one end of the shaft section 106 of the secondary transfer back-up roller 72 by means of the fixing member 110 is disposed on the side frame 100*b*. Receiving sections 130 (FIG. 5) for laterally supporting one end of each of the wrap-in roller 68, the wrap-out roller 70, the scraper back-up roller 74, and the brush back-up roller 76 via the bearings 104 are respectively disposed on the inner side of the side frame 100*b*. One end of the primary transfer roller 66 is supported on the side frame 100*b* via the bearing 104 and an unillustrated retention member.

The protective cover 102*a* has a cover main body 135*a*, a grip 136, a protruding section 138, the protrusions 140, 140, and the fixing sections 142, 142. The cover main body 135*a* which is made from, e.g., ABS resin and, being elastic, covers the intermediate transfer member 64 and the intermediate transfer member cleaner 82 from above. The grip 136 is made from, e.g., a flexible material, and is disposed on the upper surface of the cover main body 135*a* so that an operator can grip the image forming unit 96. The protruding section 138 is, e.g., integrally formed with the cover main body 135*a*, and protrudes toward the fuser 90 (FIG. 1), to thus prevent entry of extraneous materials on the upper surface of the cover main body 135*a* into the image forming apparatus main body 12. The protrusions 140, 140 are respectively engaged with the recessed sections 116, 116 on the side frames 100*a*, 100*b*. The fixing sections 142, 142 are respectively fixed in the hole sections 120, 120 on the side frames 100*a*, 100*b* by means of the fixing members 110, 110.

The protective cover 102*b* has a cover main body 135*b*, the protrusions 144, 144, and the fixing sections 146, 146. The cover main body 135*b* which is made from, e.g., ABS resin and has elasticity, and is curved so as to cover the intermediate transfer member 64 and the intermediate transfer member cleaner 82 from below. The protrusions 144, 144 are respectively engaged with the recessed sections 122, 122 on the side frames 100*a*, 100*b*. The fixing sections 146, 146 are respectively fixed in the hole sections 126, 126 in the side frames 100*a*, 100*b* by means of the fixing members 110, 110.

More specifically, the side frames 100*a*, 100*b* are disposed substantially parallel to the rotating direction of the image carrier 50 and the intermediate transfer member 64. Further, the side frames 100*a*, 100*b* are linked with each other at three positions via the protective covers 102*a*, 102*b* which respectively cover the top and the bottom of the intermediate transfer member 64 and the shaft section 106 of the secondary transfer back-up roller 72, thereby determining relative locations of components of the image forming unit 96, and cover the sides of the image carrier 50, the intermediate transfer device 62, and the intermediate transfer member cleaner 82. The image forming unit 96 is fixed on the side frames 100*a*, 100*b* with opposing ends of the shaft section 106 of the secondary transfer back-up roller 72. Accordingly, the vicinity of the secondary transfer position of the intermediate transfer member 64 is exposed at all times.

Meanwhile, the protective covers 102*a*, 102*b* have elasticity as described above, and are fixed to the side frames 100*a*, 100*b* with the recessed sections and the protruding sections on opposing ends in a staggered manner. Furthermore, the primary transfer roller 66, the wrap-in roller 68, the wrap-out roller 70, the scraper back-up roller 74, and the brush back-up roller 76 are respectively supported on the side frames 100*a*, 100*b* via the bearings 104, and each has play with respect to the side frames 100*a*, 100*b*. As described above, the primary transfer roller 66, the wrap-in roller 68, the wrap-out roller 70, the scraper back-up roller 74, and the brush back-up roller 76 each have play, thereby allowing rotation of the rollers with respect to the side frames 100*a*, 100*b*. The range of each play is restricted by the protective covers 102*a*, 102*b*.

That is, the image forming unit 96 exposes the vicinity of the secondary transfer position of the intermediate transfer member 64 at all times, and has flexibility to allow torsion.

Next, actions of the embodiment will be described.

When an image forming signal is transmitted, the image carrier 50 is uniformly charged by the electrifying device 52. Light rays are emitted toward the thus-charged image carrier 50 from the exposure device 60 on the basis of an image signal. The light rays emitted from the exposure device 60 expose the surface of the image carrier 50, thereby forming a latent image. A latent image formed on the image carrier 50 by the exposure device 60 is subjected to development of toner images of yellow, magenta, cyan, and black toners by the rotary development device 38, and the thus-transferred toner images are superposed on the intermediate transfer member 64 through primary transfer. Waste toners remaining on the image carrier 50 after the primary transfer are scraped by the image carrier cleaner 54 and collected.

Meanwhile, in response to a paper supply signal, or the like, paper stored in the paper supply cassette 22 is fed by the feed roller 24; dispensed by the retard roller 26 and guided to the transport path 28; temporarily stopped by the registration roller 32; and at an appropriate timing, guided to the space between the secondary transfer roller 80 and the secondary back-up roller 72. When the paper is guided to the space between the secondary transfer roller 80 and the secondary transfer back-up roller 72, the toner image which has been primarily transferred on the intermediate transfer member 64 is secondarily transferred on the paper by means of the secondary transfer roller 80 and the secondary transfer back-up roller 72. Waste toners remaining on the intermediate transfer member 64 after the secondary transfer are scraped by the intermediate transfer member cleaner 82 and collected.

The paper on which the toner image is transferred is guided to the fuser 90, where the toner image is fixed by thermal pressure applied by the heating roller 92 and the pressing roller 94. The paper on which the toner image is fixed is discharged by the discharge roller 34 to the discharge section 36 by way of the discharge port 30.

Next, a method for attaching/detaching the image forming unit 96 of the embodiment will be described.

Figure 8:
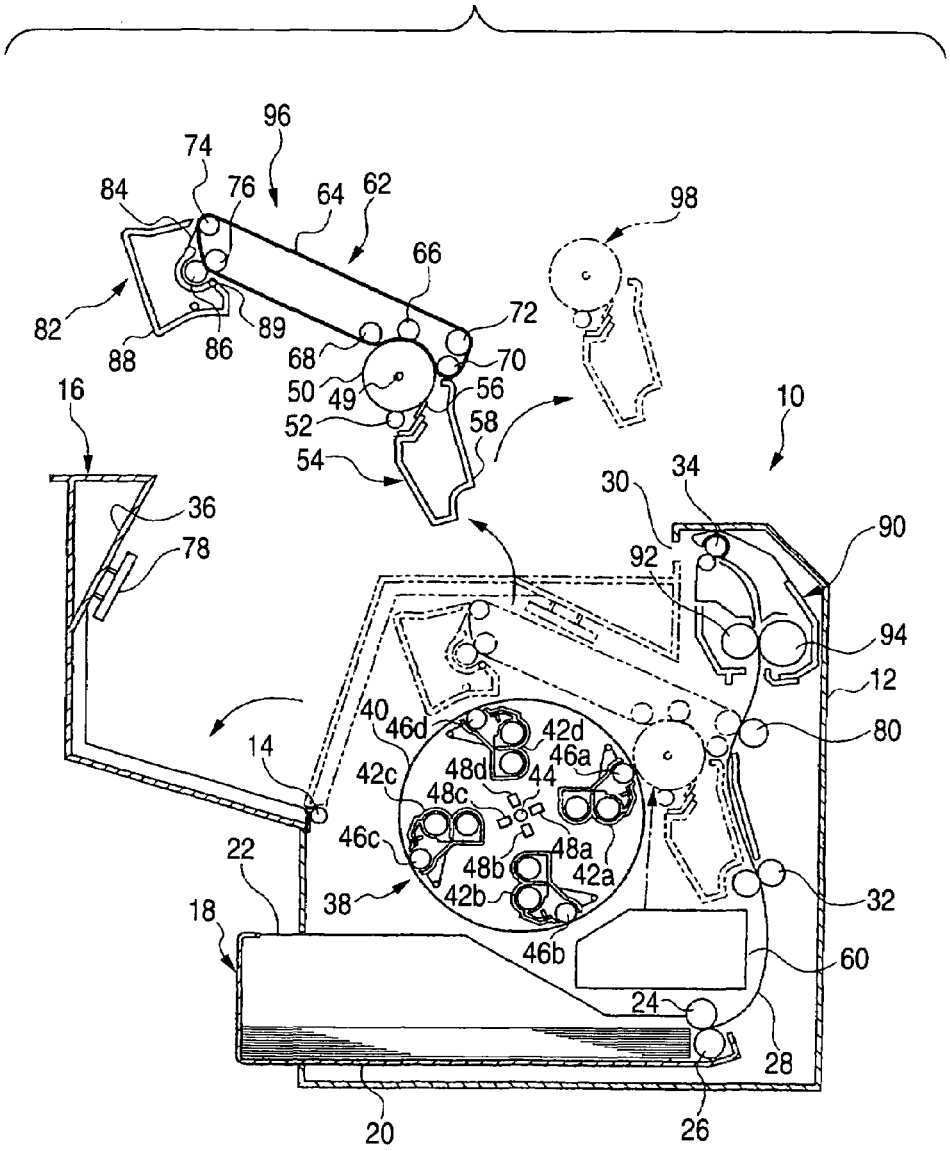
FIG. 8 is a side view showing an image forming apparatus manufactured according to the method for manufacturing the same according to the embodiment of the present invention under a state of being detached from the image forming apparatus main body.

FIG. 8 shows a state where the image forming unit 96 is detached from the image forming apparatus main body 12. When the image forming unit 96 is detached from the image forming apparatus main body 12, the reclosable cover 16 of the image forming apparatus main body 12 is rotated about the pivot 14, whereby the upper portion of the image forming apparatus main body 12 is opened. The intermediate transfer device 62 and the image carrier 50 are disposed between the fuser 90 and the rotary developing device 38 in the image forming unit 96. The image forming unit 96 is removed from the image forming apparatus main body 12 in a forward oblique direction (in an oblique, leftward and upward direction in FIG. 8) through a space between the fuser 90 and the rotary developing device 38. As described above, the image forming unit 96 is removed without opening the transport path 28.

Furthermore, the image forming unit 96 can be attached to/detached from the image forming apparatus main body 12, and is attached to the image forming apparatus main body 12 by means of opening the reclosable cover 16.

The image carrier unit 98 can be attached to/detached from the intermediate transfer assembly 97 with the image forming unit 96 detached from the image forming apparatus main body 12.

Figure 9:
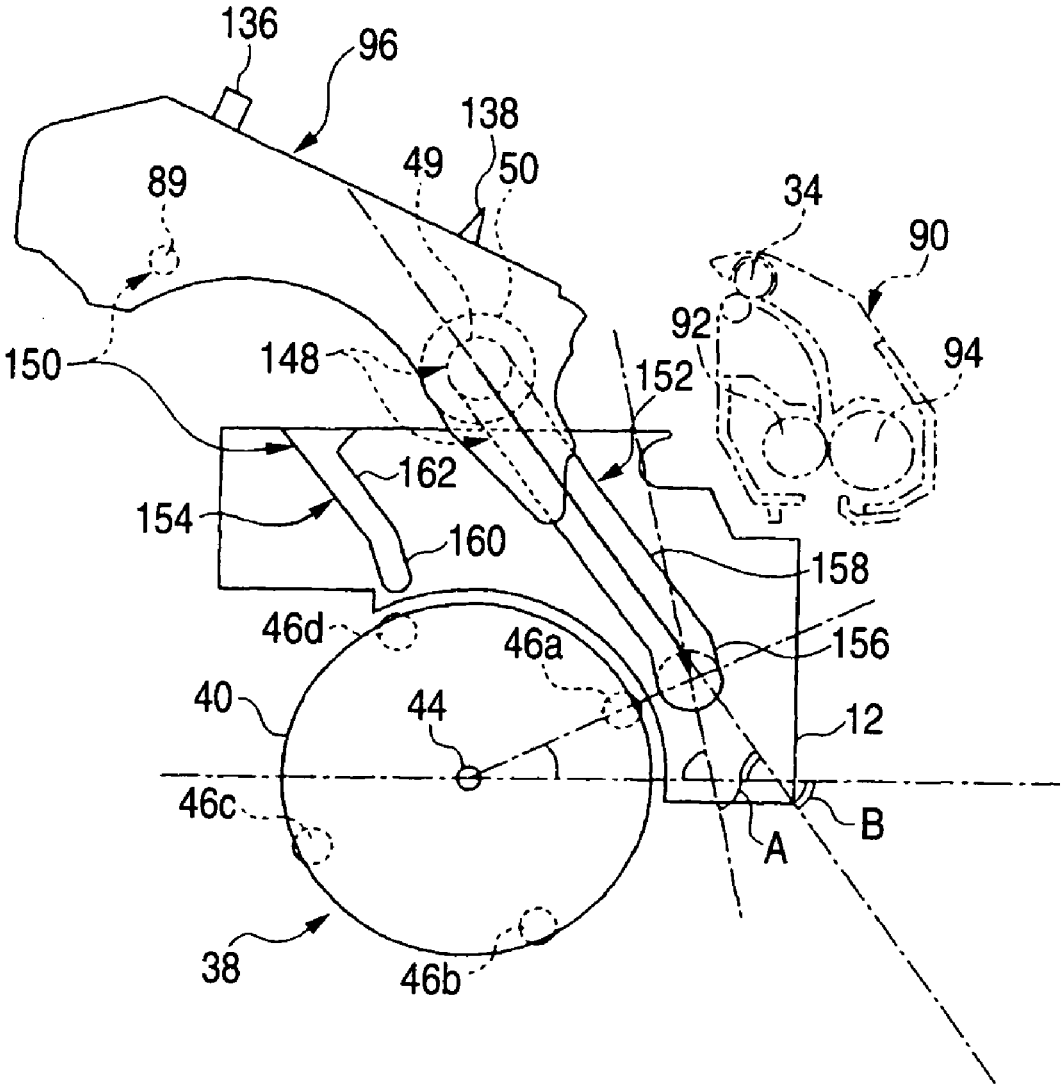
FIG. 9 is a side view schematically showing directions where the image forming unit manufactured according to a method for manufacturing the same according to the embodiment of the present invention is attached to an image forming apparatus main body.

FIG. 9 schematically shows directions in which the image forming unit 96 is attached to the image forming apparatus main body 12. The image forming unit 96 is guided along main positioning means 148 and auxiliary positioning means 150 as a result of the grip 136 being held, and attached to/detached from the image forming apparatus main body 12 in a predetermined direction. The grip 136 is set such that, e.g., when held from the above, the image forming unit 96 assumes an insertion orientation (the orientation shown in FIG. 9) toward the image forming apparatus main body 12. In other words, when the operator lifts the image forming unit 96 upward by gripping the grip 136, the image forming unit 96 is held while being inclined with the image carrier cleaner 54 located at a lower position.

The main positioning means 148 is configured from, e.g., a guide groove 152 disposed on the image forming apparatus main body 12 side, and the pivotal shaft 49 of the image carrier 50 protruding laterally from the image forming unit 96. The pivotal shaft 49 is formed in the shape of a cylinder to be engaged with the groove 152, and moves along the groove guide 152. The auxiliary positioning means 150 is configured from, e.g., an auxiliary groove 154 disposed on the image forming apparatus main body 12 side, and the pivotal shaft 89 of the intermediate transfer member cleaner 82 protruding laterally from the image forming unit 96. The pivotal shaft 89 is formed, e.g., in the shape of a cylinder to be engaged with the auxiliary groove 154, and moves along the auxiliary groove 154.

A contacting/departing guide groove 156 is formed on the lower portion in the guide groove 152 at an angle A from the horizontal, and a displacement guide groove 158 is formed on the upper portion in the guide groove 152 at an angle B from the horizontal. A contacting/departing auxiliary guide groove 160 is formed on the lower portion in the auxiliary groove 154 at the angle A from the horizontal, and a displacement auxiliary guide groove 162 is formed on the upper portion in the auxiliary groove 154 at the angle B from the horizontal. The angle A is assumed to be, e.g., 70 . . . , and the angle B is assumed to be, e.g., 55 . . . . Therefore, when the pivotal shafts 49 and 89 are displaced along the contacting/departing guide groove 156 and the contacting/departing auxiliary guide groove 160, respectively, the image forming unit 96 is displaced so as to come in contact with or separate from the rotary developing device 38 in substantially the tangential direction of the rotary developing device 38. Moreover, when the pivotal shafts 49 and 89 are displaced along the contacting/departing guide groove 158 and the contacting/departing auxiliary guide groove 162, respectively, the image forming unit 96 is displaced substantially along the tangent which passes through the developing position of the rotary developing device 38.

As described above, relative locations of the respective components configuring the image forming unit 96 are determined by the side frames 100*a*, 100*b*; and the image forming unit 96 has flexibility to allow torsion. Therefore, when the pivotal shafts 49 and 89 are displaced along the guide groove 152 and the auxiliary groove 154, respectively, the respective components configuring the image forming unit 96 are positioned to predetermined locations with respect to the image forming apparatus main body 12. Namely, without involvement of positioning adjustment of the intermediate transfer member 64, the image carrier 50, and the like, which would be performed in only the image forming unit 96, positioning adjustment of the secondary transfer back-up roller 72 with respect to the secondary transfer roller 80 and positioning adjustment of the image carrier 50 with respect to the rotary developing device 38 can be performed by means of attaching the image forming unit 96 to the image forming apparatus main body 12. Furthermore, meandering of the intermediate transfer member 64, or the like, can be prevented.

As described above, the intermediate transfer member cleaner 82 sways on the pivotal shaft 89; the image carrier 50 rotates about the pivotal shaft 49, thereby driving the intermediate transfer member 64 to rotate. More specifically, since the shaft driven by the image forming apparatus main body 12 side is directly positioned with respect to the image forming apparatus main boy 12, deformation of the image forming unit 96 caused by driving force which drives the image forming unit 96 can be prevented.

The image forming unit 96 may be guided to the guide groove 152 and the auxiliary groove 154, irrespective of the nature of a combination of portions of components configuring the image forming unit 96, such as portions of the side frames 100*a*, 100*b* and portions of the plurality of rollers supporting the intermediate transfer member 64.

Next, a method for manufacturing the image forming unit 96 will be described.

Figure 10:
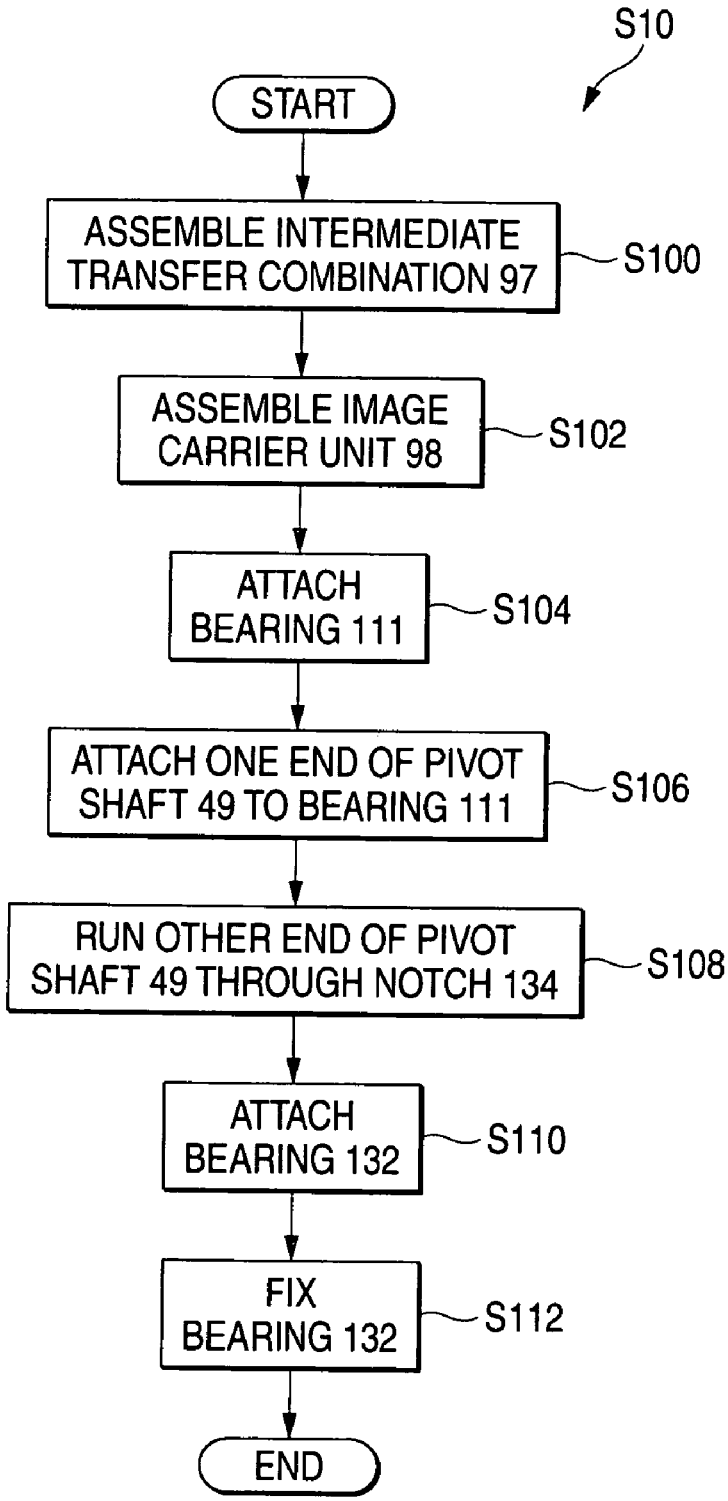
FIG. 10 is a flow chart (S10) showing a method of manufacturing the image forming unit.

FIG. 10 is a flowchart showing a method for manufacturing the image forming unit 96.

As shown in FIG. 10, in step 100 (S100) a worker assembles the intermediate transfer assembly 97 from the side frames 100*a*, 100*b*, the protective covers 102*a*, 102*b*, the intermediate transfer device 62, and the intermediate transfer member cleaner 82.

In step 102 (S102), the worker assembles the image carrier unit 98 from the image carrier 50, the electrifying device 52, and the image carrier cleaner 54.

In step 104 (S104), the worker attaches the bearing 111 to the hole section 112 in the side frame 100*a*.

In step 106 (S106), the worker inserts one end of the pivotal shaft 49 of the image carrier 50 into the bearing 111 attached to the hole section 112, and attaches the same.

In step 108 (S108), the worker turns the pivotal shaft 49 attached to the bearing 111 with one end of the pivotal shaft serving as a pivot; and runs the other end of the pivotal shaft 49 through the notch 134 in the side 100*b* against repulsion from the intermediate transfer member 64.

In step 110 (S110), the worker attaches the bearing 132 to the other end of the pivotal shaft 49, which has been run through the notch 134, from the axial direction of the pivotal shaft 49.

In step 112 (S112), the worker fixes the bearing 132 to the side frame 100*b* by means of the fixing member, thereby completing assembly of the image carrier unit 98.

As described above, the image carrier unit 98 is assembled against repulsion from the intermediate transfer member 64 of the intermediate transfer assembly 97, thereby exerting tension on the intermediate transfer member 64. That is, when the intermediate transfer assembly 97 is assembled, tension is not applied to the intermediate transfer member. Accordingly, the worker can easily assemble the intermediate transfer assembly 97.

Assembly of the intermediate transfer assembly 97 (S100) and that of the image carrier unit 98 (S102) can be performed independently. That is, the order may be reversed. The bearing 111 may be attached to the hole section 112 in conjunction with the pivotal shaft 49 after being attached to one end thereof.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image forming unit comprising:

an intermediate transfer belt having elasticity;

a plurality of rollers around which the intermediate transfer belt is wound;

a pair of side frames for connecting the rollers; and a photosensitive member installed in the side frames, wherein one of the side frames includes a closed hole section in which one end of the photosensitive member is attached; and the other side frame includes a notch into which the other end of the photosensitive member is inserted.

2. A method for manufacturing an image forming unit, comprising:

assembling an intermediate transfer assembly having an intermediate transfer belt which is elastic, a plurality of rollers around which the intermediate transfer belt is wound, and side frames which support the rollers;

inserting a cylindrical photosensitive member into the side frames so that the photosensitive member exerts tension on the intermediate transfer belt.

3. The method for manufacturing an image forming unit according to claim 2, wherein the photosensitive member and the intermediate transfer belt are brought into contact with each other in a wrapping manner by installing the photosensitive member.

4. The method for manufacturing an image forming unit according to claim 2, wherein the side frames are disposed on opposing ends of the rollers; and wherein the photosensitive member is assembled by inserting one end of the photosensitive member into one of the side frames, and subsequently inserting the other end of the photosensitive member to the other one of the side frames.

5. The method for manufacturing an image forming unit according to claim 4, wherein one end of the photosensitive member is inserted into a hole section disposed in one of the side frames, and subsequently the other end of the photosensitive member is inserted into the notch disposed in the other one of the side frames.

6. The method for manufacturing an image forming unit according to claim 2, wherein the step of inserting the cylindrical photosensitive member occurs after the step of assembling the intermediate transfer assembly.

7. The method for manufacturing an image forming unit according to claim 5, wherein the hole section comprises a closed hole.

* * * * *